US010193286B2

(12) United States Patent
Chang Chien

(10) Patent No.: US 10,193,286 B2
(45) Date of Patent: Jan. 29, 2019

(54) ELECTRONIC DEVICE AND CONTROL METHOD THEREOF

(71) Applicant: ASUSTeK COMPUTER INC., Taipei (TW)

(72) Inventor: Ching-Heng Chang Chien, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 159 days.

(21) Appl. No.: 15/215,580

(22) Filed: Jul. 20, 2016

(65) Prior Publication Data

US 2017/0033558 A1 Feb. 2, 2017

Related U.S. Application Data

(60) Provisional application No. 62/198,690, filed on Jul. 30, 2015.

(30) Foreign Application Priority Data

Jan. 30, 2016 (TW) ..... 105103043 A

(51) Int. Cl.

| | |
|---|---|
| ***H01H 47/00*** | (2006.01) |
| ***H01H 35/00*** | (2006.01) |
| ***H01H 83/18*** | (2006.01) |
| ***H01H 3/02*** | (2006.01) |
| ***H01H 3/42*** | (2006.01) |
| ***H01R 29/00*** | (2006.01) |
| ***H01R 13/641*** | (2006.01) |

(52) U.S. Cl.
CPC ..... *H01R 29/00* (2013.01); *H01R 13/641* (2013.01)

(58) Field of Classification Search
CPC ..... H01R 29/00; H01R 13/641
USPC ..... 307/126
See application file for complete search history.

(56) References Cited

U.S. PATENT DOCUMENTS

| | | | | |
|---|---|---|---|---|
| 2010/0013539 | A1 | 1/2010 | Novak | |
| 2013/0103966 | A1* | 4/2013 | Liu | G06F 1/266 713/340 |
| 2014/0223037 | A1 | 8/2014 | Minoo et al. | |

FOREIGN PATENT DOCUMENTS

| | | | |
|---|---|---|---|
| CN | 1916879 | A | 2/2007 |
| CN | 104267781 | A | 1/2015 |
| TW | I396348 | B | 5/2013 |
| TW | 201439781 | A | 10/2014 |

* cited by examiner

*Primary Examiner* — Carlos D Amaya
(74) *Attorney, Agent, or Firm* — CKC & Partners Co., Ltd.

(57) ABSTRACT

An electronic device comprising a first connector is provided. The first connector is connected to an external device. The first connector includes a first pin and a second pin. The electronic device determines whether the electronic device is electrically connected to the external device according to a voltage level of the first pin. When the electronic device is connected to the external device, the electronic device determines whether to supply power to the external device according to a voltage level of the second pin. A control method thereof is also provided.

8 Claims, 2 Drawing Sheets

ELECTRONIC DEVICE AND CONTROL METHOD THEREOF

CROSS-REFERENCE TO RELATED APPLICATION

This application claims the priority benefit of U.S. provisional application Ser. No. 62/198,690, filed on Jul. 30, 2015 and Taiwan application serial No. 105103043, filed on Jan. 30, 2016. The entirety of the above-mentioned patent applications are hereby incorporated by references herein and made a part of specification.

BACKGROUND OF THE INVENTION

Field of the Invention

The disclosure relates to a functional expansion system and, more specifically, to a functional expansion system of a portable electronic device.

Description of the Related Art

In consideration of the size and the cost, some function modules cannot easily configured inside portable electronic devices such as tablet computer, smart phone etc. However, even if the function modules can be disposed inside the portable electronic devices, it is inconvenient for a user to replace the function modules configured inside the device body. Therefore, a single electronic device cannot meet the diverse requirements of different users.

BRIEF SUMMARY OF THE INVENTION

According to a first aspect, an electronic device comprises a first connector including a first pin and a second pin, configured to connect to an external device, wherein the electronic device determines whether the electronic device is electrically connected to the external device according to a voltage level of the first pin; when the electronic device is connected to the external device, the electronic device determines whether to supply power to the external device according to a voltage level of the second pin.

According to a second aspect, an electronic device adapted to an external device, comprises a first processing circuit configured to receive a detecting signal and a power setting signal; and a connector electrically connected to the first processing circuit; wherein when the electronic device is connected to the external device via the connector, the detecting signal switches from a first level to a second level, and the first processing circuit determines whether the electronic device supplies power to the external device according to the power setting signal.

According to a third aspect, a control method comprises determining whether an external device is connected to an electronic device according to a detecting signal; determining whether the electronic device needs to supply power to the external device according to a power setting signal when the external device is connected to the electronic device; and outputting a corresponding power switching signal to control a power switching circuit of the electronic device to selectively supply power between the electronic device and the external device.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

In the disclosure, the term "connect" or "couple" means "electrically connect" or "electrically couple". The term "connect" or "couple" also means the interaction or cooperation between/among two or more components. In addition, the words "first", "second" and the like are used to distinguish individual elements/operations that have the same technical terms, but not refer to any special item or imply any sequence unless expressly stated.

Figure 1:
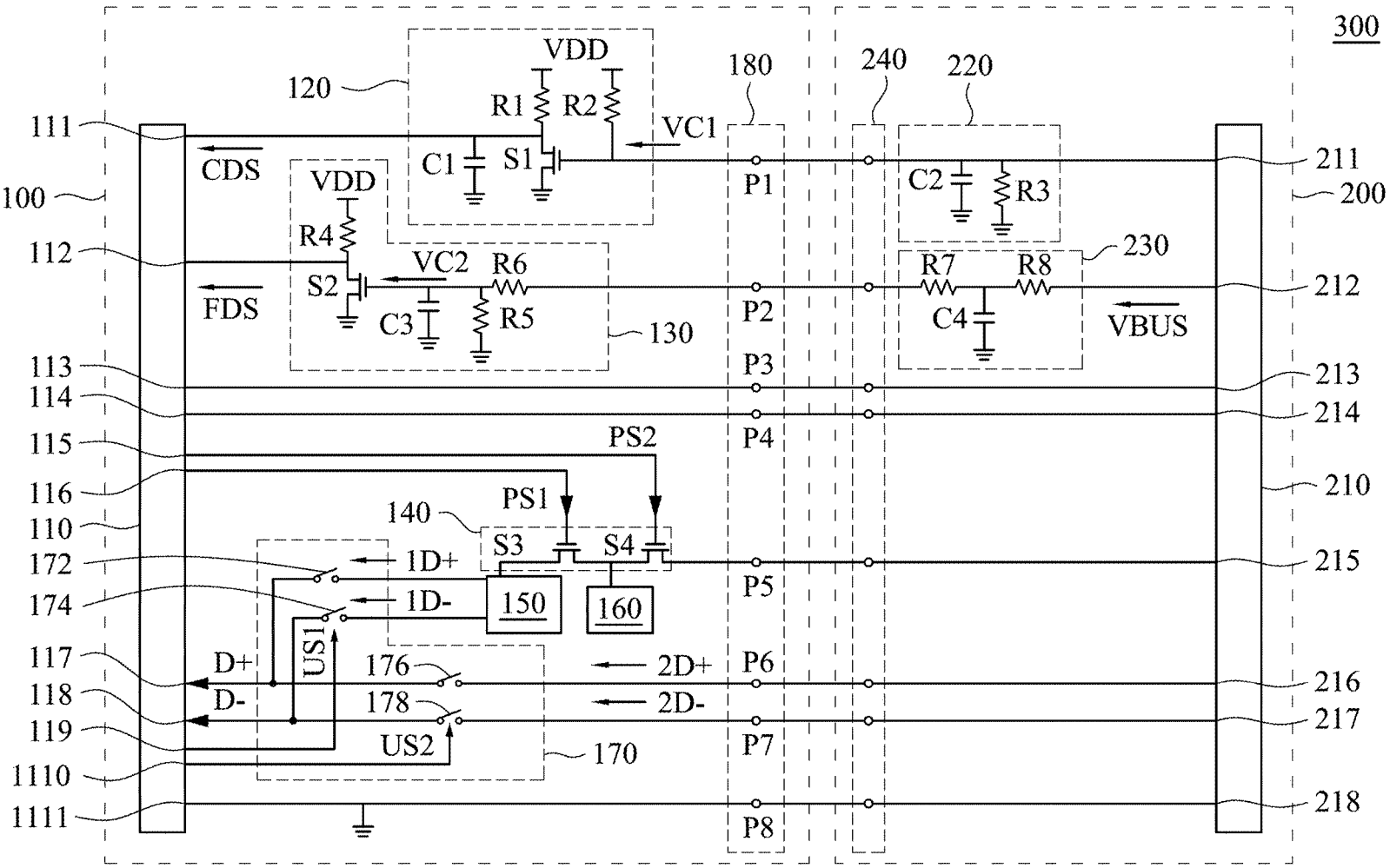
FIG. 1 is a schematic diagram showing a functional expansion system in an embodiment.

Referring to FIG. 1, FIG. 1 is a schematic diagram showing a functional expansion system 300 in an embodiment. As shown in FIG. 1, a functional expansion system 300 includes an electronic device 100 and an external device 200. In the embodiment, the electronic device 100 is a personal computer, a laptop, a tablet, a smartphone or other electronic product, and the external device 200 is a detachable backplane configured to the electronic device 100. In other embodiments, the external device 200 is another function module that operates cooperatively with the electronic device.

As shown in FIG. 1, the electronic device 100 includes a processing circuit 110, a pull-up circuit 120, a power detecting circuit 130, a power switching circuit 140, an external terminal 150, a power module 160, a terminal switching circuit 170 and a connector 180. The processing circuit 110 includes terminals 111~119. The connector 180 corresponds to the connector 240 of the external device 200. The connector 180 includes pins P1~P8 which correspond to the pins of the connector 240, respectively. Details for the operations of the processing circuit 110 cooperating with other circuits are described hereinafter.

In an embodiment, the processing circuit 110 is electrically connected to the pull-up circuit 120 via the terminal 111 to receive a connection-detecting signal CDS from the pull-up circuit 120. The processing circuit 110 determines whether the external device 200 is connected to the electronic device 100 according to the connection-detecting signal CDS.

As shown in FIG. 1, in an embodiment, the pull-up circuit 120 includes resistors R1, R2, a capacitor C1 and a switch S1. A first end of the resistor R1 is electrically connected to a power source VDD, and a second end of the resistor R1 is electrically connected to a first end of the switch S1. A first end of the resistor R2 is electrically connected to the power source VDD, and a second end of the resistor R2 is electrically connected to a control terminal of the switch S1 and the pin P1 of the connector 180. A second end of the switch S1 is electrically connected to the ground. The capacitor C1 is electrically connected between the first end of the switch S1 and the ground.

When the electronic device 100 is not connected to the external device 200, a voltage VC1 at the control terminal of the switch S1 is controlled to be at a high level by the power source VDD. Thus the switch S1 is turned on to connect the terminal 111 to the ground, and thus the connection-detecting signal CDS received at the terminal 111 of the processing circuit 110 is at a low level.

When the electronic device 100 is connected to the external device 200, the pull-down circuit 220 of the external device 200 is electrically connected to the pull-up circuit 120 via the pin P1 of the connector 180. As shown in FIG. 1, in an embodiment, the pull-down circuit 220 includes a capacitor C2 and a resistor R3 that are arranged in parallel. When the pull-down circuit 220 is electrically connected to the pull-up circuit 120, the voltage VC1 received at the control terminal of the switch S1 is a dividing voltage of the voltage VDD on the resistor R3. With the configuration of the resistance value of the resistor R3, the voltage VC1 is at a low level, thus the switch S1 is turned off. When the switch S1 is turned off, the power source VDD is divided on the resistor R1 and the capacitor C1, and thus the electric potential at the terminal 111 rises from the low level to a high level. Therefore, when the electronic device 100 is connected to the external device 200, the processing circuit 110 detects that the connection-detecting signal CDS switches from the low level to the high level.

Therefore, with the operation of the pull-up circuit 120, the processing circuit 110 determines whether the external device 200 is connected to the electronic device 100 according to the voltage level of the connection-detecting signal CDS.

The terminal 112 is electrically connected to the power detecting circuit 130 to receive a setting signal FCS from the power detecting circuit 130, and thus the processing circuit 110 determines whether the external device 200 includes a battery or other power source according to the setting signal FCS. Thus, the processing circuit 110 determines whether the electronic device 100 supplies power to the external device 200 according to the power setting signal FCS.

As shown in FIG. 1, in the embodiment, the power detecting circuit 130 includes resistors R4, R5, R6, a capacitor C3 and a switch S2. A first end of the resistor R4 is electrically connected to the power source VDD, a second end of the resistor R4 is electrically connected to the terminal 112 and a first end of the switch S2. A control terminal of the switch S2 is electrically connected to a first end of the capacitor C3, a first end of the resistor R5 and a first end of the resistor R6. A second end of the switch S2, a second end of the capacitor C3 and a second end of the resistor R5 are electrically connected to the ground. A second end of the resistor R6 is electrically connected to the pin P2 of the connector 180.

In an embodiment, the power control circuit 230 of the external device 200 includes resistors R7, R8 and a capacitor C4. The resistors R7, R8 are arranged in series. When the external device 200 is connected to the electronic device 100, a first end of the resistor R7 is electrically connected to the second end of the resistor R6 via the pin P2. A first end of the capacitor C4 is electrically connected to a second end of the resistor R7. A second end of the capacitor C4 is electrically connected to the ground. A first end of the resistor R8 is electrically connected to the second end of the resistor R7, and a second end of the resistor R8 is electrically connected to the processing circuit 210 of the external device 200 via a terminal 212.

The terminal 212 is a power terminal of the external device 200. When the external device 200 includes a separate power source (in an embodiment, the separate power source is a battery), a voltage VBUS at the terminal 212 is at a high level. As shown in figures, the voltage VC2 received at the control terminal of the switch S2 is a dividing voltage of the voltage VBUS through the resistors R6~R8 and the capacitors C3, C4, which is also at a high level. Therefore, the switch S2 connects the terminal 112 to the ground, and thus the power setting signal FCS received at the terminal 112 of the processing circuit 110 is at a low level.

When the external device 200 does not include a separate power source, the voltage VBUS at the terminal 212 is at a low level, and thus the voltage VC2 received at the control terminal of the switch S2 is at a low level. Thus the switch S2 is turned off. When the switch S2 is turned off, the power source VDD is supplied to the terminal 112 via the resistor R4, and thus the power setting signal FCS received at the terminal 112 of the processing circuit 110 is at a high level. Therefore, the processing circuit 110 determines whether the external device 200 includes a separate power source according to the power setting signal FCS, and thus determines whether the electronic device 100 needs to supply power to the external device 200.

In an embodiment, the pin P2 of the connector 180 is coupled to the power terminal 212 via the connector 240. When the connector 180 and the connector 240 are connected to each other, the power detecting circuit 130 of the electronic device 100 detects whether the pin P2 is at a first level (for example, a low level) or a second level (for example, a high level). When the pin P2 is at the first level, the electronic device 100 supplies power to the external device 200 via the pin P5.

In an embodiment, the terminals 113, 114 are first communication interfaces. For example, the terminals 113, 114 are inter-integrated circuit (I2C) interfaces. In an embodiment, the terminals 113, 114 are serial data terminals (SDA) and serial clock terminals (CLK) respectively. When the external device 200 and the electronic device 100 are connected via the connector 240 and the connector 180, the terminals 113, 114 are electrically connected to corresponding terminals 213, 214 of the I2C interfaces in the processing circuit 210 of the external device 200 via the corresponding pins P3, P4 of the connector 180, respectively. Therefore, data transmission between the processing circuit 110 and the processing circuit 220 is conducted via the pins P3, P4.

In an embodiment, the I2C interfaces transmit an identification instruction via the serial data terminal and the serial clock terminal, and thus the electronic device 100 determines the type of the external device 200 according to the identification instruction received at the pins P3 and P4. Therefore, the electronic device 100 executes a corresponding software program to exchange data or supply power according to different external devices 200. In an embodiment, the external device 200 is a detachable backplane with a storage device, a battery module, a stereo speaker, a photographic lens module, or a near-field communication (NFC) module. When the detachable backplane is assembled to the electronic device 100, the corresponding software program is executed via the cooperative operations of the processing circuits 110, 210 and the connector 180. Thus, additional storage capacity, a power source, an output of a sound source, or/and a communication function is further provided by the detachable backplane.

The terminals 115, 116 are electrically connected to the power switching circuit 140. The processing circuit 110 outputs power switching signals PS1, PS2 to the power switching circuit 140. As shown in FIG. 1. In the embodiment, the power switching, circuit 140 includes switches S3 and S4. The switch S3 is configured between the external terminal 150 and the power module 160. The switch S3 is alternatively on/off according to the power switching signal PS1. The switch S4 is configured between the power module 160 and the pin P5. The switch S4 is alternatively on/off according to the power switching signal PS2.

The power module 160 includes a battery for supplying power to the electronic device 100. When the external power source (in an embodiment, the external power source is a mobile power source unit or a charger) is connected to the electronic device 100 via the external terminal 150, the processing circuit 110 outputs a corresponding power switching signal PS1 to conduct the switches S3, and thus the external power source charges the battery of the power module 160 via the external terminal 150.

When the external device 200 and the electronic device 100 are connected, the processing circuit 110 outputs a corresponding power switching signal PS2 to make the switch S4 conducted, and thus the power module 160 of the electronic device 100 and the terminal 215 of the external device 200 are connected via the pin P5. In an embodiment, the battery of the power module 160 can supply power to the external device 200 via the terminal 215, and the external device 200 can charge the battery of the power module 160 via the terminal 215.

In an embodiment, when the external device 200 is an amplification device (such as, a stereo audio speaker) without separate power source, the power module 160 supplies power to the external device 200 via the terminal 215 and the pin P5. When the external device 200 includes a power unit for the extended battery module, the external device 200 can charge the power module 160 via the terminal 215.

When the external power source (in an embodiment, the power source is a mobile power unit or a charger) is connected to the electronic device 100 via the external terminal 150, meanwhile the external device 200 is connected to the electronic device 100 via the connector 180, the processing circuit 110 outputs corresponding power switching signals PS1 and PS2 simultaneously, the switches S3-S4 are conducted simultaneously, and thus the external power source supplies power to the power module 160 and the external device 200 via the external terminal 150 at the same time.

In an embodiment, the external terminal 150 is a second communication interface which is different from the first communication interface. For example, the external terminal 150 is, but not limited to, a universal serial bus (USB) interface.

In an embodiment, terminals 117~119 are electrically connected to the terminal switching circuit 170. The processing unit 110 receives data signals D+, D− from the USB interface via the terminals 117, 118, respectively, for data transmission. The processing unit 110 outputs terminal switching signals US1, US2 via the terminals 119 and 1110 to control the terminal switching circuit 170.

According to the output terminal switching signals US1, US2, the terminal switching circuit 170 selectively makes the terminals 117, 118 conducted with the corresponding data pins of the external terminal 150 to receive the data signals 1D+, 1D−, or selectively makes the terminals 117, 118 conducted with the corresponding pins P6, P7 of the connector 180 to receive the data signals 2D+, 2D− from the external device 200.

As shown in FIG. 1, in an embodiment, the terminal switching circuit 170 includes switches 172, 174, 176 and 178. When the terminal switching signal US1 output by the processing unit 110 is at a first level (for example, at a high level), while the terminal switching signal US2 is at a second level (for example, at a low level), the switches 172, 174 are turned on according to the terminal switching signal US1, and the switches 176, 178 are turned off according to the terminal switching signal US2. At this time, the terminal switching circuit 170 makes the terminals 117, 1118 conducted to receive the data signals 1D+, 1D− from the external terminal 150. Thus, the processing circuit 110 exchanges data with other devices via the external terminal 150.

When the terminal switching signal US1 output by the processing unit 110 is at a second level (for example, at a low level), while the terminal switching signal US2 is at a first level (for example, at a high level), the switches 172, 174 are turned off according to the terminal switching signal US1, and the switches 176, 178 are turned on according to the terminal switching signal US2. At the time, the terminals 117, 118 are conducted with the terminals 216, 217 of the external device 200 via the pins P6, P7 of the connector 180 to receive the data signals 2D+, 2D−. Therefore, the processing circuit 110 of the electronic device 100 is connected to the respective USB interfaces (that is, the terminals 216, 217 and the terminals 117, 118) of the external device 200 and the electronic device 100 via the pins P6 and P7 of the connector 180 to transmit data according to the identification instruction.

A terminal 1111 is electrically connected to the ground to be regarded as a reference electric potential of the processing circuit 110. When the external device 200 is connected to the electronic device 100, the terminal 1111 is connected to a corresponding terminal 218 of the processing circuit 210 of the external device 200 via the pin P8 of the connector 180, and thus the ground terminal 1111 of the electronic device 100 and the ground terminal 218 of the external device 200 are grounded. Therefore, the processing circuit 110 of the electronic device 100 and the processing circuit 210 of the external device 200 have the same reference electric potential.

With the operations of the electrical modules, the processing circuit 110 of the electronic device 100 and the processing circuit 210 of the external device 200 have data exchange and power charge via the connector 180, thus the functions of the electronic device 100 are extended via the external device 200.

As shown in FIG. 1, the connector 180 includes the pin P1 for detecting whether the electronic device 100 is connected to the external device 200 correctly, the pin P2 for determining whether the electronic device 100 supplies power to the external device 200, the pins P3, P4 (for example, the serial data terminal and the serial clock terminal) of the I2C interface, and the pin P5 (for example, the power pin), P6 (for example, D+ data pin), P7 (for example, D− data pin) and P8 (for example, the ground pin) of the USB interface.

The processing circuits 110, 210 and the connector 180 have various types in different embodiments. In an embodiment, the processing circuit is a controller or a processor. In an embodiment, the USB interface of the connector 180 includes two groups of the power pins and the ground pins. The functional expansion system 300 shown in FIG. 1 is exemplified for illustration, but not used to limit the disclosure.

Figure 2:
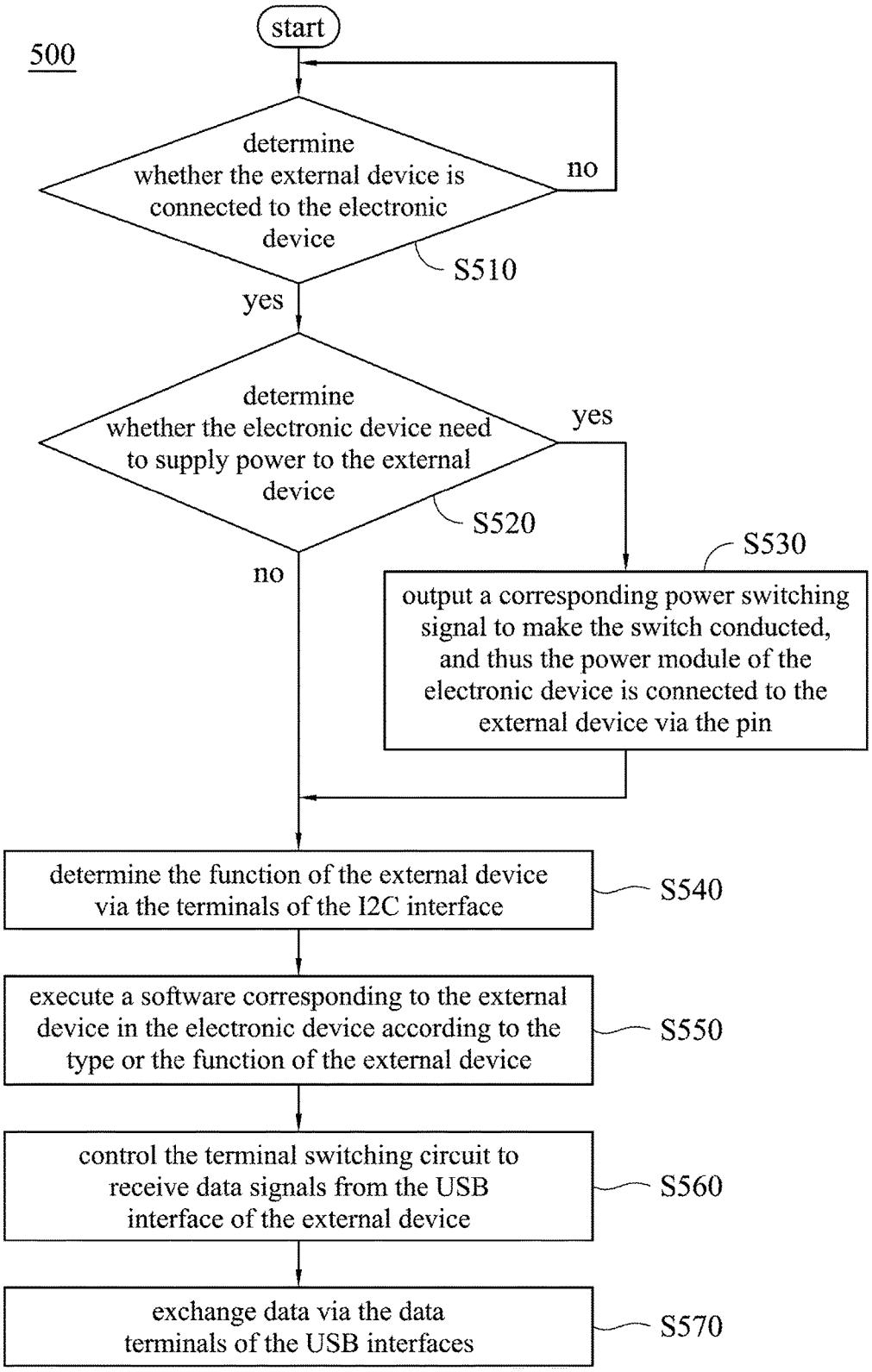
FIG. 2 is a flowchart of a control method in an embodiment.

Referring to FIG. 2, FIG. 2 is a flowchart of a control method 500 in an embodiment. A control method 500 is described accompanying with the functional expansion system 300 shown in FIG. 1, which is not limited hereinafter.

As shown in FIG. 2, the control method 500 includes steps S510, S520, S530, S540, S550, S560 and S570. In step S510, the processing circuit 110 determines whether the external device 200 is connected to the electronic device 100 according to the detecting signal COS at the terminal 111. In an embodiment, when the processing circuit 110 detects that the detecting signal CDS received at the terminal 111 is switched from a low level to a high level, it is determined that the external device 200 is connected to the electronic device 100 successfully.

When the processing circuit 110 determines that the external device 200 is connected to the electronic device, step S520 is performed. In step S520, the processing circuit 110 determines whether the external device 200 includes a battery or other power sources according to the power setting signal FCS at the terminal 112, and then determines whether the electronic device 100 needs to supply power to the external device 200. In an embodiment, when the processing circuit 110 detects that the power setting signal FCS received at the terminal 112 is at a low level, the processing circuit 110 determines that the external device 200 includes a separate power source, and thus the electronic device 100 does not need to supply power to the external device 200. When the processing circuit 110 detects that the power setting signal FCS received at the terminal 112 is at a high level, the processing circuit 110 determines that the external device 200 does not include a separate power source, and then the electronic device 100 supplies power to the external device 200.

When the processing circuit 110 determines that the electronic device 100 supplies power to the external device 200 in step S510, step S530 is performed. In step S530, the processing circuit 110 outputs a corresponding power switching signal PS2 to make the switch S4 conducted, and thus the power module 160 of the electronic device 100 is connected to the external device 200 via the pin P5. The power module 160 supplies power to the external device 200 according to the actual requirements and the type of the external device 200. In an embodiment, the power module 160 provides a direct current (DC) power supply of 5 volts to the external device 200. In an embodiment, the voltage level provided to the power module 160 is different, such as, a direct current power supply of 12 volts, 15 volts, 20 volts, according to the type of the external device 200.

After step S530, or the processing circuit 110 determines that the electronic device 100 does not need to supply power to the external device 200 in step S520, step S540 is performed. In step S540, the processing circuit 110 communicates with the corresponding terminals 213, 214 of the processing circuit 210 via the terminals 113, 114 of the I2C interface, respectively, to determine the function of the external device 200. In an embodiment, the external device 200 transmits data via the I2C interface, thus the processing circuit 110 determines that the external device 200 is a storage device, a battery module, a stereo speaker, a NFC module, or a detachable backplane with other expansion functions.

In step S550, the processing circuit 110 operates to execute a software program corresponding to the external device 200 in the electronic device 100 according to the type or the function of the external device. In an embodiment, when the external device 200 is an external storage device, the processing circuit 110 executes corresponding file management software program to allow a user to view the files stored in the external device 200, copy and transmit the files.

In step S560, the processing circuit 110 controls the terminal switching circuit 170 to make the terminals 117, 118 conducted with the corresponding terminals 216, 217 of the external device 200 via the connector 180 to receive data signals 2D+, 2D− from the USB interface.

In step S570, the processing circuit 110 and the processing circuit 210 communicate and exchange data via the data terminals 117, 118 and the terminals 216, 217 of the USB interfaces according to the identification instruction, or the processing circuit 110 and the processing circuit 210 are charged via the power terminals 116, 212 of the USB interfaces. In an embodiment, when the external device 200 includes a battery module, the external device 200 charges the power module 160 of the electronic device 100. Therefore, the battery endurance of the electronic device 100 is extended.

The sequence of the steps in the above embodiments, is not used to limit the sequence unless expressly stated, and the sequence can be adjusted according to the practical requirements. In an embodiment, at least part of the steps in the embodiment can be performed simultaneously.

The components/elements in the embodiments can be realized by various types of digital or analog circuits, or different integrated circuit chips, respectively. The components/elements can be integrated into a single digital control chip. The components/elements in the embodiments are exemplified for illustration, which is not limited herein. In an embodiment, the switches S1~S5 are metal oxide semiconductor field effect transistors (MOSFET), bipolar junction transistors (BJT) or other suitable semiconductor components. In an embodiment, the processing circuits 110 and 210 are central processing units (CPU) or other integrated circuit chips.

Although the disclosure has been disclosed with reference to certain embodiments thereof, the disclosure is not for limiting the scope. Persons having ordinary skill in the art may make various modifications and changes without departing from the scope of the disclosure. Therefore, the scope of the appended claims should not be limited to the description of the embodiments described above.

What is claimed is:

1. An electronic device comprising, a first connector including a first pin and a second pin, configured to connect to an external device, wherein the electronic device determines whether the electronic device is electrically connected to the external device according to a voltage level of the first pin;

a power switching circuit;

a power module connected to the power switching circuit; and an external terminal connected to the power module via the power switching circuit, when the electronic device is connected to the external device, the electronic device determines whether to supply power to the external device according to a voltage level of the second pin, and the power switching circuit is conducted to allow the power module to provide power for the external device when the electronic device determines to supply power to the external device.

2. The electronic device according to claim 1, wherein the first connector includes a first communication interface configured to electrically couple to the external device, and the electronic device determines a type of the external device according to an identification instruction received by the first communication interface.

3. The electronic device according to claim 2, wherein the first connector includes a second communication interface configured to electrically couple to the external device, when the electronic device determines the type of the external device according to the identification instruction, the electronic device transmits corresponding data according to the type of the external device.

4. An electronic device adapted to an external device, comprising, a first processing circuit configured to receive a detecting signal and a power setting signal; and a connector electrically connected to the first processing circuit;

a power module configured to supply power to the electronic device;

an external terminal; and a power switching circuit configured to conduct the power module according to a first power switching signal output by the first processing circuit to supply power between the external device and the power module, and configured to conduct the power module with the external terminal according to a second power switching signal output by the first processing circuit to supply power between the external terminal and the power module, wherein when the electronic device is connected to the external device via the connector, the detecting signal switches from a first level to a second level, and the first processing circuit determines whether the electronic device supplies power to the external device or not according to the power setting signal.

5. The electronic device according to claim 4, further comprising, a pull-up circuit configured to output the detecting signal to the first processing circuit; and a power detecting circuit configured to output the power setting signal to the first processing circuit according to a voltage signal received by the external device.

6. A control method comprising, determining whether an external device is connected to an electronic device according to a detecting signal;

determining whether to supply power from the electronic device to the external device according to a power setting signal when the external device is connected to the electronic device;

outputting a corresponding power switching signal to control a power switching circuit of the electronic device to selectively supply power between the electronic device and the external device;

coupling to the external device and receiving an identification instruction via a first communication interface of the electronic device;

outputting a power switching signal to conduct a power module of the electronic device according to the identification instruction;

supplying power between the electronic device and the external device via the power module;

outputting a terminal switching signal to conduct a second communication interface of the electronic device with a second communication interface of the external device according to the identification instruction; and transmitting data between the electronic device and the external device via the second communication interface of the electronic device and the second communication interface of the external device.

7. An electronic device adapted to an external device, comprising, a first processing circuit configured to receive a detecting signal and a power setting signal; and a connector electrically connected to the first processing circuit;

an external terminal; and a terminal switching circuit configured to conduct the first processing circuit with the external terminal according to a first terminal switching signal output by the first processing circuit and configured to conduct the first processing circuit with a data terminal of the connector according to a second terminal switching signal output by the first processing circuit, to selectively receive a data signal from the external terminal or the external device, wherein when the electronic device is connected to the external device via the connector, the detecting signal switches from a first level to a second level, and the first processing circuit determines whether the electronic device supplies power to the external device or not according to the power setting signal.

8. The electronic device according to claim 7, further comprising, a pull-up circuit configured to output the detecting signal to the first processing circuit; and a power detecting circuit configured to output the power setting signal to the first processing circuit according to a voltage signal received by the external device.

* * * * *